US005243313A

United States Patent [19]

Basnett

[11] Patent Number: 5,243,313

[45] Date of Patent: Sep. 7, 1993

[54] TRACTIVE MAGNET WITH ASYMMETRIC PERMANENT AIR GAP

[75] Inventor: Robert T. Basnett, Horse Shoe, N.C.

[73] Assignee: Westinghouse Electric Corp., Pittsburgh, Pa.

[21] Appl. No.: 945,476

[22] Filed: Sep. 16, 1992

[51] Int. Cl.[5] ..... H01F 7/12; H01H 50/60

[52] U.S. Cl. ..... 335/247; 335/131; 335/277

[58] Field of Search ..... 335/247, 131, 132, 258, 335/273, 255, 84, 85, 104, 277

[56] References Cited

U.S. PATENT DOCUMENTS 4,739,293 4/1988 Hurley et al. ..... 335/132

*Primary Examiner*—Harold Broome
*Attorney, Agent, or Firm*—M. J. Moran

[57] ABSTRACT

An E shaped stationary magnet/moveable armature combination for use in an electromagnetic contactor. The magnet has three legs; two outer legs and an inner leg. The armature can be a single, essentially rectangular bar or have three legs corresponding to the legs of the magnet. The moveable armature is caused to contact the magnet by a magnetic field created when electrical current is applied to a current carrying coil. An outer leg of the magnet and/or armature is arranged such that an air gap remains between an outer leg of the magnet and armature. The provision of an air gap in an outer leg reduces noise emitted from the electromagnet.

23 Claims, 3 Drawing Sheets

TRACTIVE MAGNET WITH ASYMMETRIC PERMANENT AIR GAP

BACKGROUND OF THE INVENTION

1. Field of the Invention

This invention relates to an electromagnetic switch having a stationary magnet with a plurality of legs and a moving armature having a corresponding plurality of legs. The invention particularly relates to the disposition of an air gap between an outer leg of the magnet and a corresponding outer leg of the armature to reduce audible noise from the closed magnet.

2. Description of the Prior Art

Electromagnetic contactors are switch devices which are especially useful in motor-starting, lighting, switching, and similar applications. Typically, a contactor has a fixed magnet and a movable magnet (armature). A relatively large air gap resides between the fixed magnet and armature when the contactor is opened. To close the contactor an electromagnetic coil is energized to electromagnetically accelerate the armature towards the magnet. The electromagnetic acceleration should be of sufficient magnitude to overcome the bias of contact pressure springs and a kick-out spring used to separate the armature from the magnet when energy is removed from the coil.

The armature preferably is provided with electrically conductive contacts. When the coil is energized to cause the armature to contact the magnet, the electrically conductive contacts touch stationary contacts affixed in a switch housing. Contact touching generally provides a circuit closure for energizing a circuit or a load.

Typically, contactors are classified as either DC electromagnet devices or AC electromagnet devices. More recently, however, electromagnets are required to operate with chopped waveform excitation that is neither sinusoidal alternating current nor direct current. Magnets operating with chopped waveform excitation have a great propensity to emit objectionable audible noise.

In alternating current contactors, audible noise is caused by the coil voltage returning to zero at a rate determined by the frequency of the power supply, typically 60 Hz. The noise is caused by the armature movement relative to the magnet due to the varying magnitude of the energization signal. In the past, shading coils have been added to the magnetic circuit to reduce the noise. The shading coils provide a current flow even when the voltage is zero i.e., at each zero crossing of the AC-waveform. The current flow results in a force that keeps the magnet closed and acceptably quiet. The shading coils, however, reduce efficiency and increase cost. In simple, electrical systems it would be advantageous to eliminate the use of a shading coil.

An additional means for reducing noise in an electromagnetic contactor includes high tolerance machining of the contacting faces of the respective legs of the armature and magnet. The high tolerance machining smoothes the respective contacting faces of the armature and magnet thereby eliminating noise which would otherwise be present from the grating of one "rough" face against another. The extra machining which is necessary, however, is prohibitively expensive and time consuming.

In AC and DC energized contactors, a non-magnetic gap is usually added to the path of the magnetic system to limit the residual magnetism that causes magnetic sticking. The gap ensures that residual magnetic flux is low, whereby the kick-out spring can quickly open the switch upon cessation of electrical energy to the coil.

Typically, E-shaped magnets and armatures are used in prior art electromagnetic contactors. When an E-shaped magnet is used in prior art systems, an air gap is added to the magnetic path of the center leg by making that leg shorter than the outside magnet legs. As noted above, this air gap increases the magnetic reluctance of the closed magnetic path thus reducing the residual magnetism. A reduction in residual magnetism makes the kick-out spring more effective for separating the magnets during a contactor opening operation. However, in an E-shaped magnetic member, vibration of the center leg due to the fact that there is some room for movement and caused by a magnetic force on the center legs of the magnet and armature to touch causes deflection of the spine of the E-shaped member of the armature, magnet or both thereby allowing the outer leg pieces of the magnet and armature to wipe against each other. The movement of the outer leg pieces causes noise and also causes the outer leg faces to wear which eventually causes the center leg air gap to disappear and the residual magnetism to increase dramatically.

To eliminate the problem of the noise caused by the bending of the spine of an E-shaped permanent magnet armature and the consequent rubbing together of leg faces, and yet to continue to provide a contactor wherein residual magnetic flux is kept to a minimum, the device of U.S. Pat. No. 4,739,293-Hurley et al. was provided. Hurley, et al. teaches a contactor having an E-shaped magnet and armature wherein the center legs of the magnet and armature each have significant magnetic material removed from their faces leaving complimentary ribs or protrusions which mate or make with each other as the outer legs make or mate with each other. The ribs or protrusions are small enough to magnetically saturate and function as though they were an airgap. The removal of the magnetic material keeps residual magnetism at a minimum allowing the kick-out spring to separate the magnetic members during an opening operation.

When machined properly, the device of Hurley, et al. successfully reduces residual magnetism allowing for separation of the magnetic members by the kick-out spring and decreases audible noise. However, in Hurley et al. each of the opposing faces of the armature and the magnet must be precisely aligned or else relative movement of the armature with respect to the magnet will cause objectionable audible noise. The precise machining required of the device disclosed in Hurley, et al. increases the cost of manufacture.

There is a need, therefore, to provide an electromagnetic contactor having low audible noise and low residual magnetism thereby allowing the magnet/armature combination to separate quickly and efficiently during an opening operation.

SUMMARY OF THE INVENTION

These and other needs are satisfied by the invention which is directed to a stationary magnet and a moveable armature housed in an electromagnetic switch structure. The armature of the invention can be a number of various shapes and sizes. For purposes of this disclosure, the armature has a profile of an downward facing E, thereby providing three legs and three confronting faces for contact with a stationary magnet. The stationary magnet has, for purposes of disclosure, a profile of an upward facing E having three legs and three confronting faces. Although the magnet and armature can be constructed in a number of ways from a number of materials, sintered powdered iron or laminated sheet iron materials are preferred. The armature resides in a carrier which allows armature movement along an axis to or from the magnet. The armature is typically biased away from the magnet by a kick-out spring. When the coil structure of the electromagnet is energized, the armature travels through the carrier towards the magnet.

Upon energization, the opposing confronting faces of an outer leg of the armature and a corresponding one of the magnet and the center leg of the armature and the corresponding center leg of the magnet impact and remain in contact during the energization period. The confronting face of the remaining outer leg of the armature and the confronting face of the corresponding remaining leg of the magnet are separated by a small air gap. The air gap can be a wide range of sizes but is preferably around 20 thousandths of an inch (20 mils) (0.508 mm). The size of the air gap is dictated by a number of considerations such as the magnetic force which must be exerted on the armature to induce it to overcome the opposing force of a kick-out spring and contact springs to contact the magnet, the hardness of the magnetic material, and the number closing operations anticipated. If a relatively large magnetic force is required to induce the armature to contact the magnet, it will be necessary to provide a relatively small gap to avoid significantly reducing the forces of attraction between the armature and magnet. On the other hand, when the magnetic material is soft, or when a great number of closing operations are anticipated, the gap should be relatively large to prevent an eventual closing of the gap as the magnetic material wears over time from repeated switch operations.

The air gap can be provided by shortening an outside leg of the magnet relative to the length of the other outside leg and the center leg, shortening the length of an outer leg of the armature relative to the other outer leg and the center leg or shortening each of an outer leg of the armature and the corresponding outer leg of the magnet. For example, an outer leg of the magnet can be shortened by 20 mils (0.508 mm) relative to the other outer leg and the center leg of the magnet. An outer leg of the armature can be shortened by 20 mils (0.508 mm) relative to the other outer leg and the center leg of the armature. Finally, an outer leg of the magnet and the corresponding outer leg of the armature can each be shortened 10 mils (.0254 mm) relative to the lengths of all other legs.

The air gap limits residual magnetic flux when excitation of the coil is removed thereby eliminating a tendency for the armature to remain in contact with the magnet even after excitation ceases. In this manner, the kick-out spring in combination with contact spring forces can quickly separate the magnet from the armature after the stoppage of excitation. Furthermore, and in accordance with this invention, the location of the air gap in an outside leg eliminates or reduces the generation of objectionable audible noise from the energized electromagnet, especially when the electromagnet is energized with a chopped waveform signal and shading coils are not employed.

BRIEF DESCRIPTION OF THE DRAWINGS

For a better understanding of the invention, reference may be had to the preferred embodiments thereof, shown in the accompanying drawings in which.

DESCRIPTION OF THE PREFERRED EMBODIMENTS

The invention is a magnet assembly usable in an electromagnetic switch having a stationary magnet, the magnet having a contacting outer leg and a non-contacting outer leg and at least one inner leg, the outer legs and the at least one inner leg having confronting faces, a movable armature having at least one opposing confronting face for contacting the confronting faces of the at least one inner leg and the contacting outer leg when the armature is moved into contact with the magnet, including an air gap disposed between the confronting face of the non-contacting outer leg and the armature whereby the confronting face of the non-contacting outer leg fails to contact the at least one opposing confronting face of the armature when the armature is moved into contact with the magnet thereby reducing audible noise when the electromagnetic switch is energized and in a closed state.

Figure 1:
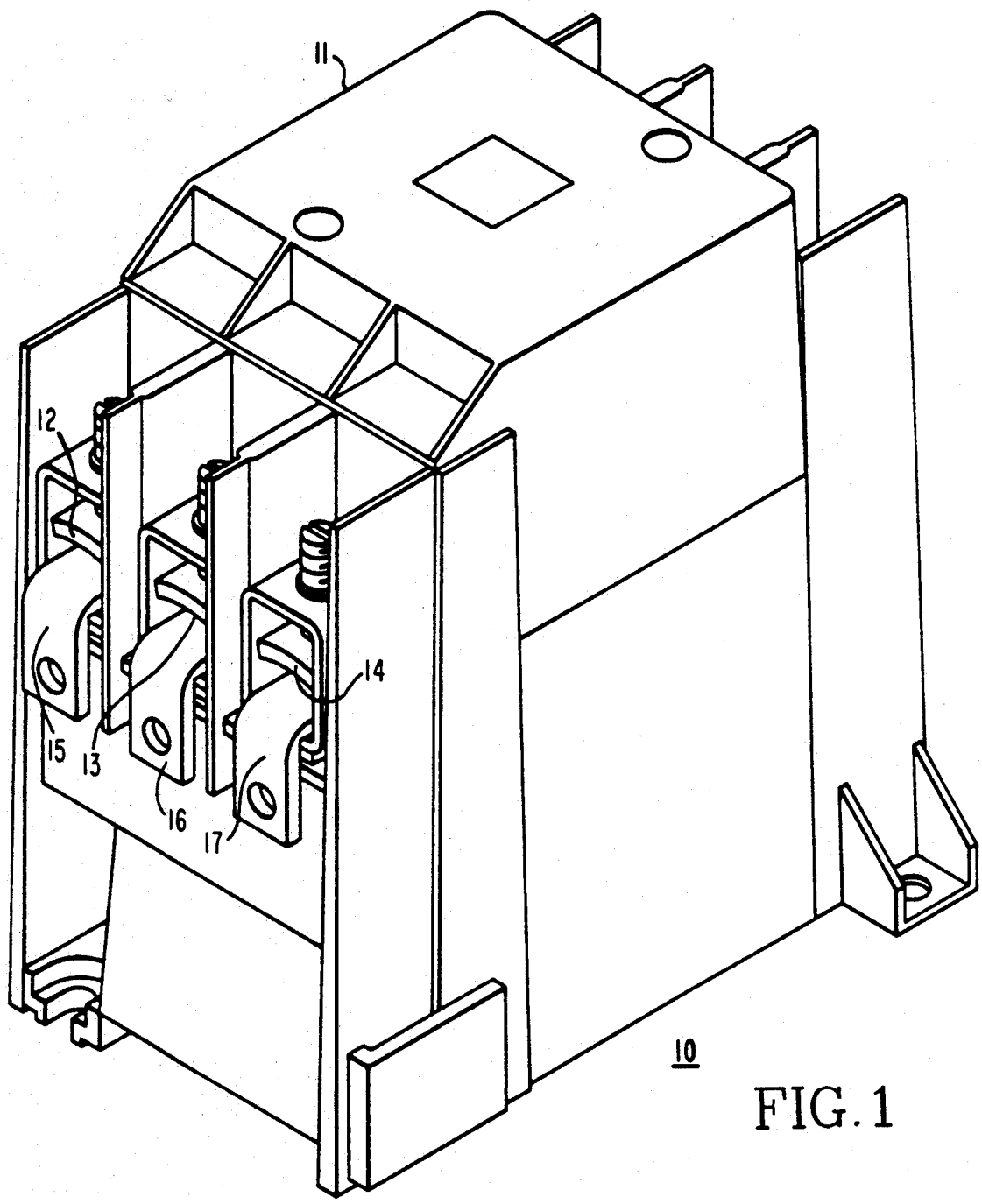
FIG. 1 shows an isometric view of an electromagnetic contactor to which the invention is applied.

FIG. 1 depicts an electromagnetic switch contactor 10. Contactor 10 comprises housing 11 made of suitable electrical insulating material such as a glass/nylon composition upon which are disposed electrical load terminals 12, 13 and 14. Terminals 12, 13 and 14 are spaced apart and interconnected internally with conductors 15, 16, and 17, respectively, which extend into the central region of housing 11. Conductors 15, 16 and 17 are terminated by appropriate fixed contacts. The opposite pole of the contactor is connected to three conductors (not shown) opposing conductors 15, 16 and 17. Closing of the contacts will establish circuit continuity between conductors 15, 16 and 17 and their respective opposing conductors. In this manner, electrical continuity is established between terminals 12, 13 and 14 and respective opposing terminals.

Figure 2:
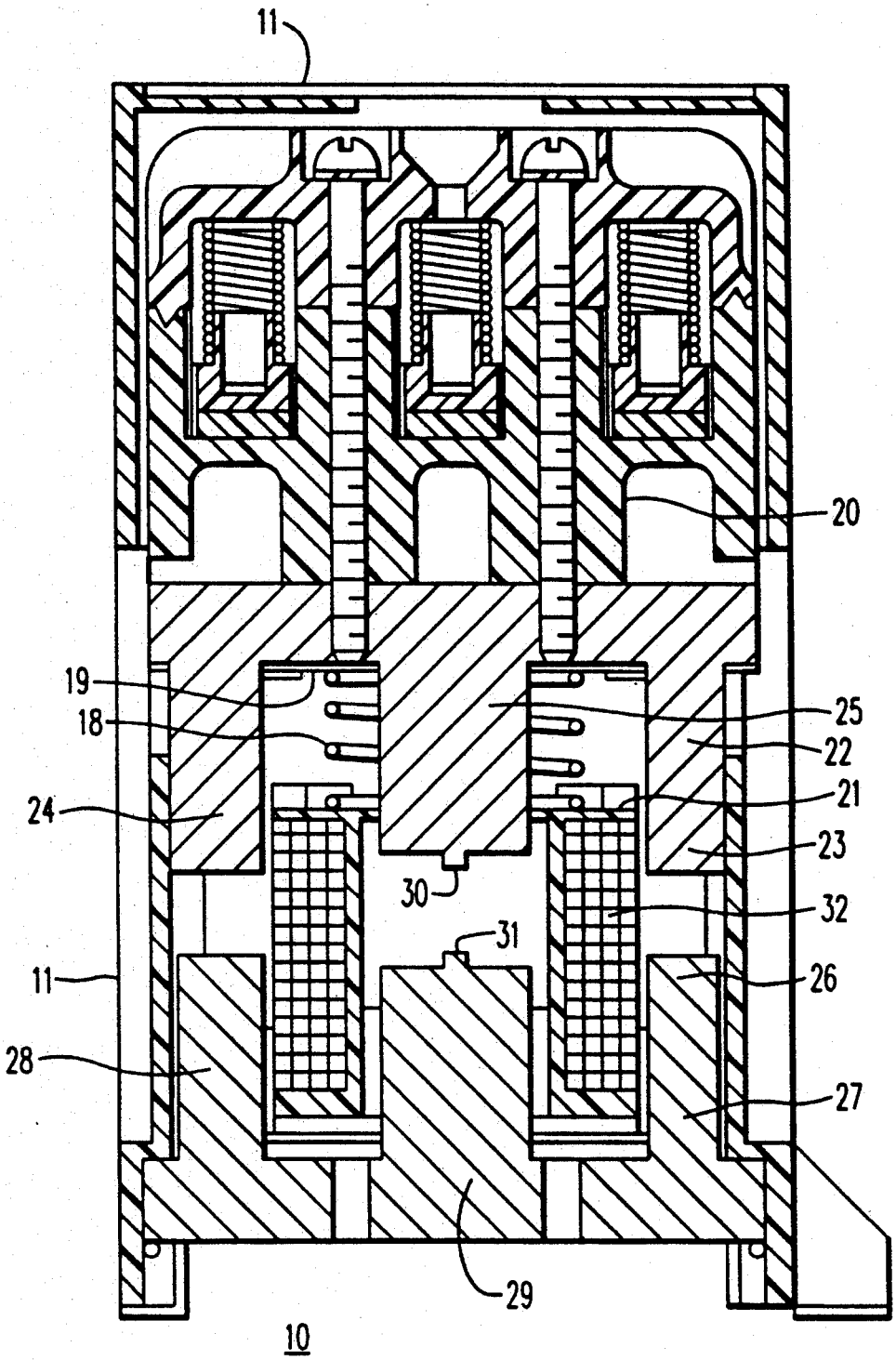
FIG. 2 PRIOR ART
FIG. 2 shows a cutaway elevation of the contactor of FIG. 1 embodying teachings of the prior art.

FIG. 2 shows a magnet assembly inside of housing 11 corresponding to the prior art. A top portion of kick-out spring 18 is trapped against a lip 19 on the bottom portion of spacer 20. A lower portion of kick-out spring 18 rests on spring seat 21. Kick-out spring 18 biases movable armature 22 having outer legs 23 and 24 and center leg 25 away from stationary magnet 26. Stationary magnet 26 has outer legs 27 and 28 and center leg 29.

As noted, FIG. 2 depicts a prior art armature/magnet design wherein movable armature 22 has rib 30 on center leg 25. Stationary magnet 26 has an opposing rib 31 on center leg 29. Electrical energization of coil 32 by electrical power provided by an external source and in response to a contact closing signal generates a magnetic flux path through stationary magnet 26 and armature 22. As is well known, such a condition causes the armature 22 to longitudinally move within housing 11 towards stationary magnet 26. The attraction of armature 22 to stationary magnet 26 is sufficient to overcome the opposing bias of kick-out spring 18. Eventually, armature 22 moves into contact with stationary magnet 26. Outer legs 23 and 24 abut, respectively, with outer legs 27 and 28. Opposing ribs 30 and 31 further abut. The reduced contacting area resulting from the provision of ribs 30 and 31 rather than full-sized center legs lessens residual magnetic flux that would tend to keep armature 22 in contact with stationary magnet 26 even after removal of electrical energy from coil 32. The contactor of FIG. 2, however, is prone to objectionable audible noise when energized, especially when energized with a non-sinusoidal alternating wave form and when the contacting faces of legs 23, 24, 27 and 28 and ribs 30 and 31 are not precisely aligned or machined.

Figure 3A:
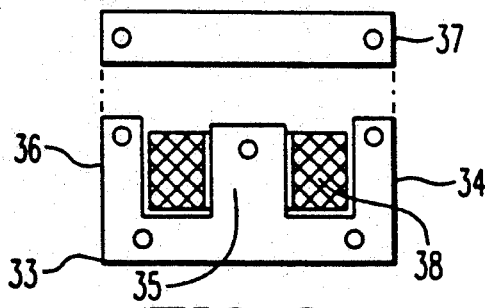
FIG. 3A PRIOR ART
FIG. 3A is a side elevation of a movable armature/-magnet combination having a middle leg air gap according to the prior art.

In other prior art designs, no rib is provided on the center leg of the stationary magnet or armature, but rather an air gap is provided. This design is shown in FIG. 3A. As shown in FIG. 3A, stationary magnet 33 is of the conventional E-shape having outer legs 34 and 36 and center leg 35. Movable armature 37 is not E-shaped but rather is essentially a flat rectangular bar. When coil 38 is energized, movable armature 37 is induced to move into contact with stationary magnet 33.

Figure 3B:
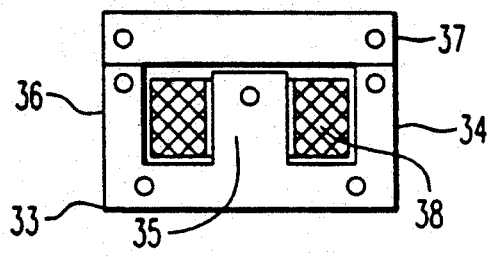
FIG. 3B PRIOR ART
FIG. 3B is a side elevation of the movable armature/-magnet combination of FIG. 3A wherein the coil is energized.

As shown in FIG. 3B, center leg 35 is slightly shorter as compared to outer legs 34 and 36 whereby a narrow rectilinear gap remains after movable armature 37 is induced to contact stationary magnet 33. Confronting faces of outer legs 34 and 36, however, are in full contact with movable armature 37. The rectilinear gap produced by the shortening of center leg 35 as compared to outer legs 34 and 36 reduces residual flux in the magnet/armature pair that would otherwise remain after termination of energization to coil 38 and which would continue to hold movable armature 37 against stationary magnet 33 even after termination of energization. The rectilinear gap of the prior art magnet/armature combination as depicted in FIGS. 3A and 3B is known, however, to cause an objectionable audible noise to emanate from the electromagnet. It is understood that the noise is caused by uneven forces acting on the magnet and armature due to the presence of the gap. For example, at closure as depicted in FIG. 3B, magnetic forces will be exerted on center leg 35 and armature 37 trying to establish physical contact between center leg 35 and movable armature 37. The resulting forces on magnet 33 and armature 37 cause movement of outer legs 34 and 36 with respect to movable armature 37, thereby producing the objectionable audible noise.

Figure 4A:
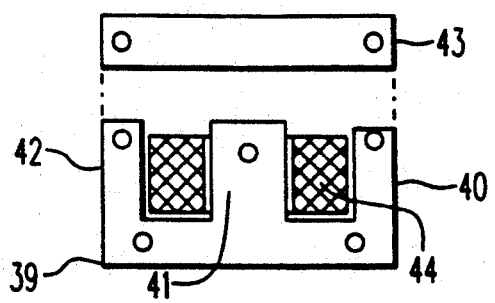
FIG. 4A is a side elevation of a movable armature/-magnet combination in accordance with the teachings of invention.
Figure 4B:
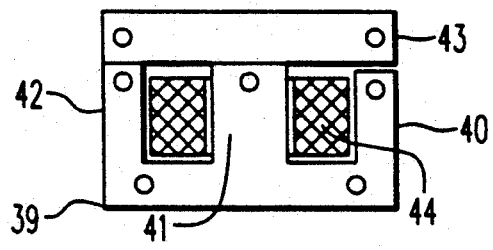
FIG. 4B is a side elevation view of the movable armature/magnet combination as shown in FIG. 4A wherein the coil is energized.

The noise is substantially reduced or eliminated from a closed magnet/armature combination when designed in accordance with the invention. As shown in FIG. 4A, the magnet 39 appears to be of conventional design having outer legs 40 and 42 and center leg 41, thus having an E-shape. Movable armature 43 is not E-shaped but is essentially a rectangular bar as previously shown and described in FIGS. 3A and 3B. In accordance with the invention, and as shown in FIGS. 4A and 4B, outer leg 42 and center leg 41 are of equal length. Outer leg 40 however, is slightly shorter as compared to center leg 41 and outer leg 42. When coil 44 is energized, and movable armature 43 is induced to contact stationary magnet 39, the faces of center leg 41 and outer leg 42 physically contact movable armature 43. A small rectilinear gap, however, remains between outer leg 40 and movable armature 43. Even if movable armature 43 is induced to contact stationary magnet 39 on a slight angle whereby movable armature 43 makes contact with outer leg 40, it has been shown that movable armature 43 will immediately seat itself so as to physically contact outer leg 42 and center leg 41 and establish the necessary gap between itself and outer leg 40. The presence of the gap between outer leg 40 and movable armature 43 reduces residual flux in the magnet 39/armature 43 combination whereby a kick-out spring and contact spring forces (not shown) can easily and readily disengage movable armature 43 from stationary magnet 39 once energy to coil 44 has been removed. Furthermore, and in accordance with the invention, the rectilinear air gap between outer leg 40 and armature 43 provides for an exceptionally quiet electromagnet, even when using chopped waveform excitation signals.

Figure 5A:
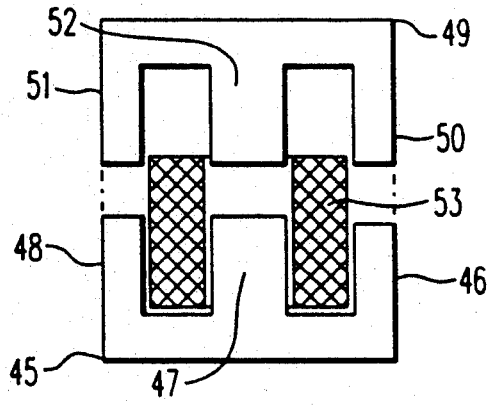
FIG. 5A is a side elevation of an alternate embodiment of the movable armature/magnet combination in accordance with the teachings of the invention wherein the movable armature is E-shaped, with three equal legs and the magnet has the right leg shortened.
Figure 5B:
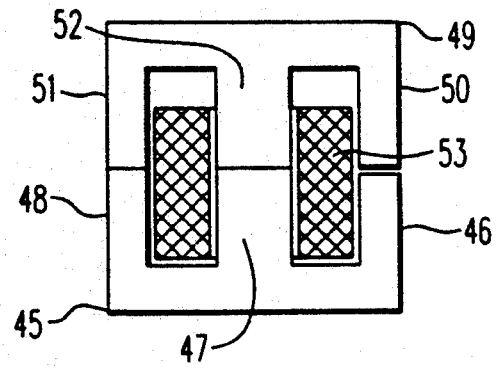
FIG. 5B is a side elevation of a movable armature/-magnet combination as shown in FIG. 5A wherein the coil is energized.

FIGS. 5A and 5B depict an alternative design of the invention. As shown in FIG. 5A, stationary magnet 45 once again is E-shaped having outer legs 46 and 48 and center leg 47. Movable armature 49 in this embodiment also is E-shaped. Movable armature 49 has outer legs 50 and 51 and center leg 52.

The stationary magnet 45/movable armature 49 combination after energization of coil 53 is shown in FIG. 5B. As is clearly shown in FIG. 5B, the faces of outer legs 48 and 51 are in physical contact, as are the faces of center legs 47 and 52. A rectilinear gap, however, exists between the faces of outer leg 46 and outer leg 50. The rectilinear gap is produced by manufacturing outer leg 46 of stationary magnet 45 slightly shorter as compared to center leg 47 and outer leg 48. As discussed above, the provision of a gap between an outer leg of stationary magnet 45 and an outer leg of movable armature 49 eliminates objectionable audible noise from the energized (closed) armature/magnet pair. Furthermore, the gap lessens residual magnetic flux which would otherwise exist after de-energization of coil 53 and which would, at least temporarily, exist in a magnitude greater than the opposing force of a kick-out spring and contact springs (not shown) to hold movable armature 49 against stationary magnet 45 even after termination of energy to coil 53.

Figure 6A:
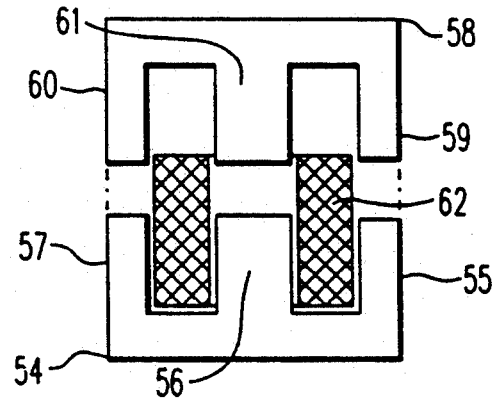
FIG. 6A is a side elevation of another alternate embodiment of a movable armature/magnet combination in accordance with the teachings of the invention, with the armature and the magnet each having one short leg, and assembled with the short legs opposing each other.
Figure 6B:
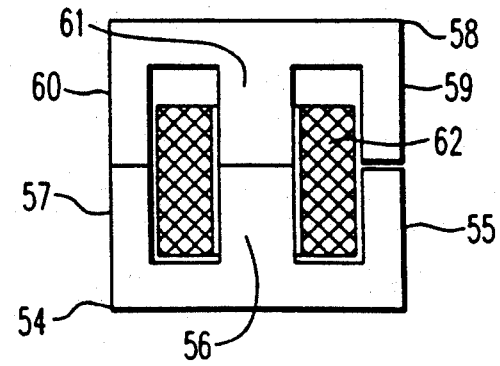
FIG. 6B is a side elevation of the movable armature/-magnet combination shown in FIG. 6A wherein the coil is energized.

FIGS. 6A and 6B show another alternate embodiment of the invention. As depicted in FIG. 6A, stationary magnet 54 has outer legs 55 and 57 and center leg 56. Moveable armature 58 has outer leg 59 corresponding to outer leg 55 of stationary magnet 54, middle leg 61 corresponding to middle leg 56 of stationary magnet 54 and other outer leg 60 corresponding to outer leg 57 of stationary magnet 54. Coil 62 is provided to induce movement of moveable armature 58 towards stationary magnet 54. Not shown is a kick-out spring biasing moveable armature 58 away from stationary magnet 54. On stationary magnet 54, outer leg 57 and center leg 56 are of equal length. Outer leg 55 is slightly shorter as compared to outer leg 57 and center leg 56. On the moveable armature 58, outer leg 60 and middle leg 61 are of equal length. Outer leg 59 is shorter relative to outer leg 60 and center leg 61.

FIG. 6B depicts the stationary magnet 54/moveable armature 58 after energization of coil 62. As shown, the corresponding faces of outer legs 57 and 60 are in contact, as are the corresponding faces of center leg 56 and center leg 61. A rectilinear gap exists between outer leg 55 and outer leg 59. The gap is produced not by only shortening outer leg 55 of magnet 54 relative to middle leg 56 and outer leg 57, but also by shortening outer leg 59 of moveable armature 58 relative to center leg 61 and outer leg 60. The result is identical, however, to that produced when only outer leg 55 is shortened and which was discussed in reference to FIGS. 5A and 5B, i.e. significant reduction of objectionable audible noise and substantial lessening of residual magnetic flux.

It can be appreciated from the above that the invention provides excellent contactor performance by virtually eliminating objectional audible noise from an energized contactor while also reducing residual flux to allow for rapid disengagement after the termination of energization.

While specific embodiments of the invention have been described in detail, it will be appreciated by those skilled in the art that various modifications and alternatives to those details could be developed in light of the overall teachings of the disclosure. For instance, the confronting faces of contacting outer legs and/or center legs can be of varying cross sectional area.

It should also be noted that either outer leg of the magnet and/or armature can be shortened to produce the necessary rectilinear gap for reducing noise and residual flux. Accordingly, the particular arrangements disclosed are meant to be illustrative only and not limiting to as to the scope of the invention which is to be given the full breath of the appended claims and any and all equivalents thereof.

What I claim is:

1. A magnet assembly usable in an electromagnetic switch having a stationary magnet, said magnet having a contacting outer leg and a non-contacting outer leg, at least one inner leg, said outer legs and said at least one inner leg having confronting faces, a moveable armature having at least one opposing confronting face for contacting the at least one confronting face of said at least one inner leg and the confronting face of the contacting outer leg when the armature is moved into contact with said magnet, wherein said confronting face of said non-contacting outer leg fails to contact said at least one opposing confronting face of the armature when the armature is moved into contact with said magnet, said non-contacting outer leg and said at least one opposing confronting face of the armature forming an air gap, thereby reducing audible noise in the assembly when the electromagnetic switch is energized into a closed state.

2. The magnet assembly of claim 1 wherein the non-contacting leg is shorter as compared to the at least one inner leg and said contacting outer leg to provide the air gap.

3. The magnet assembly of claim 1 wherein said magnet has one inner leg, the magnet thus having an E shape.

4. The magnet assembly of claim 3 wherein the armature has a separate opposing confronting face for each confronting face of the magnet.

5. The magnet assembly of claim 4 wherein the armature has two outer legs and an inner leg corresponding to the outer legs and inner leg of said magnet, the armature thus having an E shape.

6. The magnet assembly of claim 5 wherein one of the outer legs of said magnet is shorter as compared to the inner leg and other of said outer legs of said magnet to provide the air gap.

7. The magnet assembly of claim 5 wherein one of the outer legs of said armature is shorter as compared to the inner leg and the other of said outer legs of said armature to provide the air gap.

8. The magnet assembly of claim 5 wherein both an outer leg of the magnet is shorter as composed to the inner and other of said outer legs of the magnet and the corresponding outer leg of said armature is shorter as compared to the inner and other of said outer legs of the armature to provide the air gap.

9. The magnet assembly of claim 1 further comprising a coil, wherein application of electrical energy to said coil induces the moveable armature to move into contact with said magnet, said electrical energy having a non-sinusoidal waveform.

10. The magnet assembly of claim 9 further comprising a kick-out spring opposing inducement of the armature to move into contact with the magnet wherein the size of the gap is empirically determined from factors including at least one of kick-out spring bias force, relative material hardness of the magnet, relative material hardness of the armature, and a number of anticipated switch closing operations.

11. A magnet assembly usable in an electromagnetic switch, comprising:

a stationary magnet, said magnet having a first outer leg, and a center leg, said first outer leg and said center leg having a first length, and a second outer leg having a second length, said legs essentially defining an E shaped magnet; and, a movable armature having a first outer leg corresponding to and opposing said first outer leg of said magnet, a center leg corresponding to and opposing said center leg of said magnet, said first outer leg and said center leg of said armature having a first length, and a second outer leg corresponding to and opposing said second outer leg of said magnet, said second outer leg of said armature having a second length, said legs of said armature essentially defining an E shaped armature, said second lengths being arranged whereby when said armature is induced to contact said stationary magnet, an air gap remains between said second outer leg of said stationary magnet and said second outer leg of said armature thereby reducing audible noise and residual flux.

12. The magnet assembly of claim 11 wherein said second length of said second outer leg of said magnet is shorter than said first length of said first outer leg and said center leg of said magnet to provide said air gap.

13. The magnet assembly of claim 11 wherein said second length of said second outer leg of said armature is shorter than said first length of said first outer leg and said center leg of said armature to provide said air gap.

14. The magnet assembly of claim 12 wherein said second length of said second outer leg of said magnet is about 20 mils (.0508 mm) shorter than said first length of said first outer leg and said center leg of said magnet.

15. The magnet assembly of claim 13 wherein said second length of said second outer leg of said armature is about 20 mils (0.508 mm) shorter than said first length of said first outer leg and said center leg of said armature.

16. The magnet assembly of claim 11 wherein said second length of said second outer leg of said magnet is shorter than said first length of said first outer leg and said center leg of said magnet and said second length of said second outer leg of said armature is shorter than said first length of said first outer leg and said center leg of said armature.

17. The magnet assembly of claim 16 wherein said second length of said second outer leg of said magnet is about 10 mils (0.254 mm) shorter than said first length of said first outer leg and said center leg of said magnet and said second length of said second outer leg of said armature is about 10 mils (0.254 mm) shorter than said first outer leg and said center leg of said armature.

18. The magnet assembly of claim 12, further comprising a coil, wherein application of electrical energy to said coil induces said moveable armature to contact said magnet.

19. The magnet assembly of claim 13, further comprising a coil, wherein application of electrical energy to said coil induces said moveable armature to contact said magnet.

20. The magnet assembly of claim 18 further comprising a kick-out spring opposing inducement of the moveable armature to move into contact with said magnet, wherein the magnitude of the difference in length between said first length and said second length of said magnet legs is empirically determined from factors including at least one of kick-out spring bias force, relative material hardness of the magnet, relative material hardness of the armature and a number of anticipated switch closing operations.

21. The magnet assembly of claim 19 further comprising a kick-out spring opposing inducement of the moveable armature to move into contact with said magnet, wherein the magnitude of the difference in length between said first length and said second length of said armature legs is empirically determined from factors including at least one of kick-out spring bias force, relative material hardness of the magnet, relative material hardness of the armature and a number of anticipated switch closing operations.

22. The magnet assembly of claim 18 wherein the electrical energy has a non-sinusoidal waveform.

23. The magnet assembly of claim 19 wherein the electrical energy has a non-sinusoidal waveform.

* * * * *